US007104542B2

(12) United States Patent
Peterson

(10) Patent No.: US 7,104,542 B2
(45) Date of Patent: Sep. 12, 2006

(54) PULL-TAB SKILL TOURNAMENT POKER

(76) Inventor: Randall S. E. Peterson, P.O. Box 3605, Garilbaldi Highlands, Vancouver, British Columbia (CA) V0N 1T0

( * ) Notice: Subject to any disclaimer, the term of this patent is extended or adjusted under 35 U.S.C. 154(b) by 81 days.

(21) Appl. No.: 10/863,522

(22) Filed: Jun. 9, 2004

(65) Prior Publication Data

US 2005/0116416 A1 Jun. 2, 2005

(51) Int. Cl.
*A63F 1/00* (2006.01)

(52) U.S. Cl. ..... 273/274; 273/292; 273/139; 273/151; 463/11; 463/12; 463/13

(58) Field of Classification Search .... 273/100–149 R, 273/149 P, 250–299, 300–350; 463/1–49
See application file for complete search history.

(56) References Cited

U.S. PATENT DOCUMENTS 5,669,817 A * 9/1997 Tarantino ..... 463/13
5,879,233 A * 3/1999 Stupero ..... 463/11

* cited by examiner

*Primary Examiner*—Benjamin Layno
(74) *Attorney, Agent, or Firm*—John R. S. Orange; Brett J. Slaney; Santosh K. Chari

(57) ABSTRACT

A gaming system comprises a plurality of tournament tables in at least one physical location wherein multiple players play identical hands of the same game thereby playing a game of skill with equal opportunity given to each player to win. The system including for each hand played a set of pre-packaged duplicate hands distributed to each tournament table so that each player in a tournament group will play an identical hand of cards.

17 Claims, 6 Drawing Sheets

PULL-TAB SKILL TOURNAMENT POKER

FIELD OF THE INVENTION

The invention relates generally to games of skill and more particularly, to a system and method for playing a game of skill in a physical environment.

DESCRIPTION OF THE PRIOR ART

Traditionally, card games such as poker, rummy, bridge or bingo are classified as games of chance or a mix of chance and skill. In most cases, the playing of games of chance for money or prizes is classified as gambling and therefore regulated. To be classified as gambling, the game must be a game of chance where the outcome of the game is determined predominately or fully by the element of chance, there must be a monetary consideration to participate in the game and there must be the ability to win money or monies having equal or greater value than that of the consideration.

With the removal of the element of chance in a game, the game becomes a game of skill and in most cases a game of skill does not constitute gambling. The interpretation of skill as applied to a game is that a game can be considered skilful if a player can significantly affect the outcome of play as a result of his or her own actions. Devices used for the purpose of gambling are based predominately on the element of chance and thus a player would have little or no control of the outcome of the game. Games of skill are commonly played, and in particular there are methods for playing a game such as poker as a game of skill.

To play poker as a game of skill, it is necessary that the random generation of hands that are dealt to players in competition be eliminated. In traditional poker tournaments, the players at a table each have different cards and play against each other. Skill poker is implemented by duplicating the hands dealt to players in the same tournament group, such that competing players have the opportunity to play identical cards. In a skill poker tournament each table has only one member from each tournament group and each tournament group is represented at each table. This enables players at a particular table to play different cards and maintain game feel and playability while competing against players in the identical scats at the other tournament tables who are playing identical hands. For example, the players seated at seat #1 at each table are compared to determine how well they fared against the other players at their table. The collection of players located at seat #1 of each table is designated as tournament group #1. Similarly, each other seat number has a corresponding tournament group such that each table has the identical number of seats and therefore each tournament group has a representative seated at each table. Another implementation of skill poker includes each player at a table playing identical hands and thus forming a tournament group, however this implementation is less common as it does not maintain game feel and playability.

Other card games are currently played as games of skill using the same principle used in skill poker. The cards dealt are duplicated for each player in a tournament group and for a player to win, they must rely on their skill or speed. Speed may be the objective in games such as skill bingo where the player that calls "bingo" first when a winning card is discovered is deemed the winner.

At present games of skill are played over the Internet or by utilising an electronic representation of the cards over a LAN or other network. However, there does not, exist a convenient method of playing these games in a physical environment such as a bingo hall or a small poker club. In a physical environment, it would be necessary for each tournament table to be connected to a network and game server and require viewing peripherals at each player's location.

The use of physical gaming cards introduces a massive amount of organization that would be needed for even a small poker club to operate. With games of chance, shuffling the deck of cards is used to quickly randomize cards and dealing is straightforward. In a gambling scenario, it is well known that many hands can be played in even a one-hour period. To implement a game of skill however, the organization of duplicate hands for each tournament is required. A typical poker game such as Texas Holdem can play approximately 30 hands in a one hour period and this translates to 3 000 hands played in a tournament of 100 players per hour, which is typical for a medium sized poker club. This extrapolates to approximately 72 000 pre-ordered hands that must be created to accommodate a medium sized poker house for one 24 hour period of playing time. It can be seen that since the organization of cards needed to play a game of skill can become a time consuming task, a convenient method would be needed to feasibly implement a tournament of skill poker.

Conventional games of chance such as poker and blackjack have associated with them strict rules to combat cheating by the players or collusion between the players and the dealer. Even with random card shuffling, players may identify patterns of cards that are not shuffled properly or dealers may replace a random deck with a pre-ordered deck for the purpose of cheating the house odds. Gambling organizations such as casinos are required to employ staff who monitor gaming tables as a method of preventing cheating and collusion. This increases the overhead required to run a gambling organization. Furthermore, there is no easy way of auditing the proper distribution of cards in play, as the card order in the deck is unknown and untraceable without physical surveillance. The use of preordered randomized hands in games of skill, which include the dealing of duplicated hands helps to reduce the occurrence of dealer collusion. However if the dealer, or anyone in general, is responsible for pre-ordering cards there is a chance for foul play.

Furthermore, accurate auditing of player and dealer payouts for winnings and player's bets made is not accounted for in conventional gambling or games of skill. Each table and dealer has a float that is cashed in when the dealer closes their shift and specific bets and winnings paid are lost within the overall net income for that particular shift.

It is an object of the present invention to eliminate or obviate at least one of the above-mentioned disadvantages.

SUMMARY OF THE INVENTION

Accordingly, there is provided a gaming system incorporating necessary skill for play, substantially eliminating the element of chance, which is conducted in a physical environment by means of multi-player, tournament participation. Through the dealing of duplicate playing cards to each participant in a tournament group, each player has an equal chance of winning and the skill of the individual dictates the outcome of the game. Conveniently, the disclosed gaming system allows for auditing and surveillance of dealer and player actions, bet tracking and cash flow.

A first embodiment of the present invention comprises a system of a plurality of tournament tables in at least one physical location wherein multiple players play identical hands of the same game thereby playing a game of skill with equal opportunity given to each player to win. For each hand played, a set of pre-packaged duplicates is distributed to each tournament table so that each player in a tournament group will play an identical hand of cards. In a typical tournament setting, each tournament table will be distributed a set of pre packaged hands with enough in number to satisfy the length of the tournament.

Each player participating in a tournament is assigned a player number that records the number of hands played, bets made, a table number, a tournament location and other auditing information desired by the particular gaming institution. With this organization, skill games can be played in a timed fashion and particular auditing information collected in unison to create an efficient and cost effective method for playing a game of skill.

With each game, each dealer opens one set of prepackaged, pre-ordered hands and deals these to the corresponding players. This eliminates both the need to organize the hands as the games are being played and the chance for dealer and player collusion. The hands are concealed using an appropriate covering, these coverings are used as a security feature to conceal the playing cards until they are to be played. The initial hand of cards is concealed using a single covering and at the appropriate time, the players are instructed to reveal the hand to themselves. The game plays by revealing draw cards in the proper order, allowing each player to play the same cards and thereby executing a game of skill.

There are many ways of concealing the playing cards and thus pre-packaging the hands as mentioned above and may include, but is not limited to the use of perforated pull-tabs, scratch surfaces, loose playing cards in a package, or rip-open envelopes. The rip-open envelopes are folded over and attached using a perforated edge and by removing this edge, the envelope opens to reveal the hand to the players. Similarly, draw cards are also concealed by using the above mentioned methods. It is appreciated that an alternative to using prepackaged hands is to pre-order a complete deck of cards so that player's hands and draw cards are dealt in a pre-determined sequence to play a game of skill as described herein.

Multiple tournament tables in multiple physical locations can be used through the distribution of the pre-packaged sets of hands. The structure of this distribution lends to ease of tracking information regarding the success of the gaming institutions and helps to prevent cheating and dealer-player collusion by using scaled packages that contain the hands to be played.

In another embodiment of the present invention, the above method of skill gaming can be implemented with electronic equipment at each player location so as to play in a physical location under a closed network. This electronic equipment can comprise display terminals for revealing hands of cards as well as terminals to audit player actions. Furthermore, the use of electronic equipment can be used to link physical locations thereby allowing the synchronisation of multiple tournaments in many physical locations while continuing the use of a physical location to allow players to gather in a social environment. As such the above skill games can incorporate printing terminals to print hands at game time. This methods provides an alternative to using pull-tab cards, scratch cards or individually packaged playing cards to present hands for the player to play.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
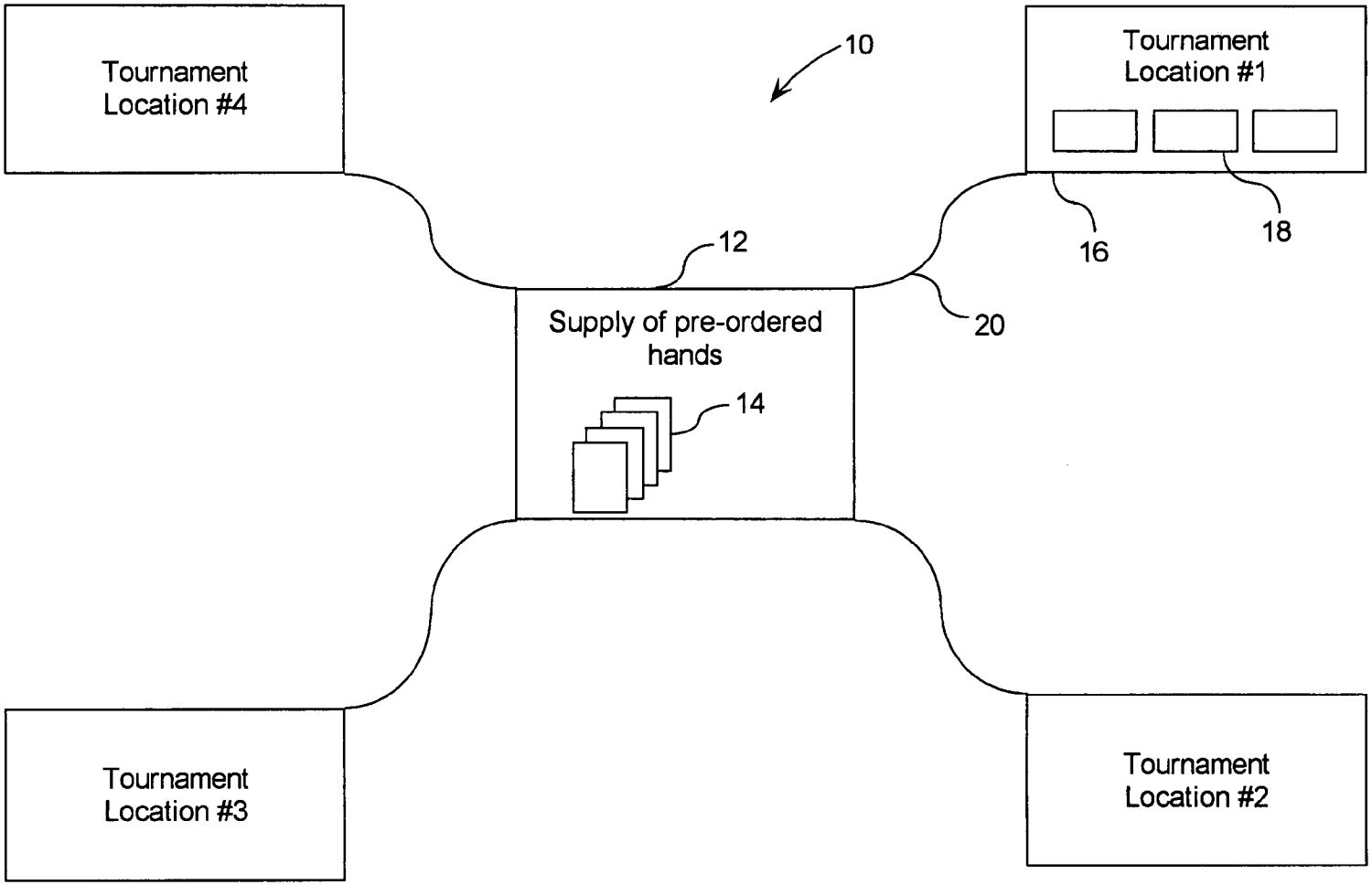
FIG. 1 is a schematic diagram of a multiple physical location, multiple tournament, game distribution.

Referring to FIG. 1, a distribution system 10 for playing a game tournament is shown, where a distribution source 12 containing a supply 12 of pre-ordered packages of hands 14 is distributed. In this case there are four separate physical tournament locations 16. At each of these locations 16, there is at least one tournament table 18. Tournament location #1 in this embodiment contains three tournament tables 18 at its physical location 16. The supply 14 is pre-organized at the distribution source 12 and sent via an appropriate distribution path 20 to each location 16 for the purpose of executing skill game tournaments at gaming establishments 16. These distribution paths can be, but are not limited to shipment via a truck, train, airplane or other motor vehicle as well as electronic shipment by means of an electronic connection such as the Internet to be viewed or printed by a suitable viewing or printing terminal at the destination.

Figure 4:
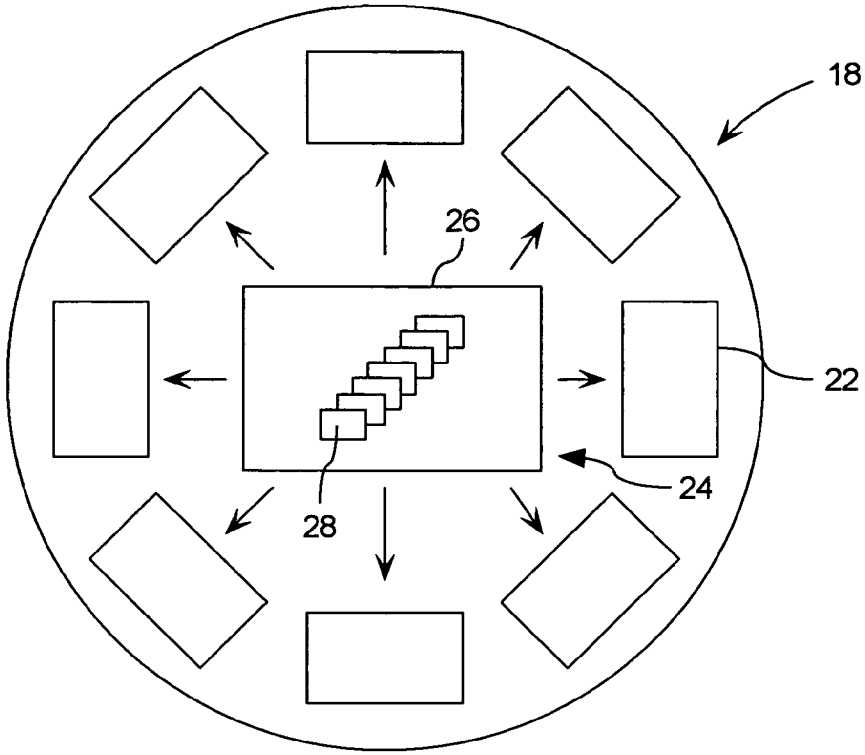
FIG. 4 is a schematic diagram of a single table within a tournament location.

Within each tournament location 16, there is at least one tournament table 18 as shown in FIG. 4. Distributed about the periphery of the table 18 are stations 22, these stations 22 are each assigned a player number and these player stations 22 are tended to by a dealer 24 assigned to that table 18. The dealer is in control of a pre-organized set 26 of pre-packaged hands 28 to be dealt for each game in a particular tournament location 16.

Figure 2:
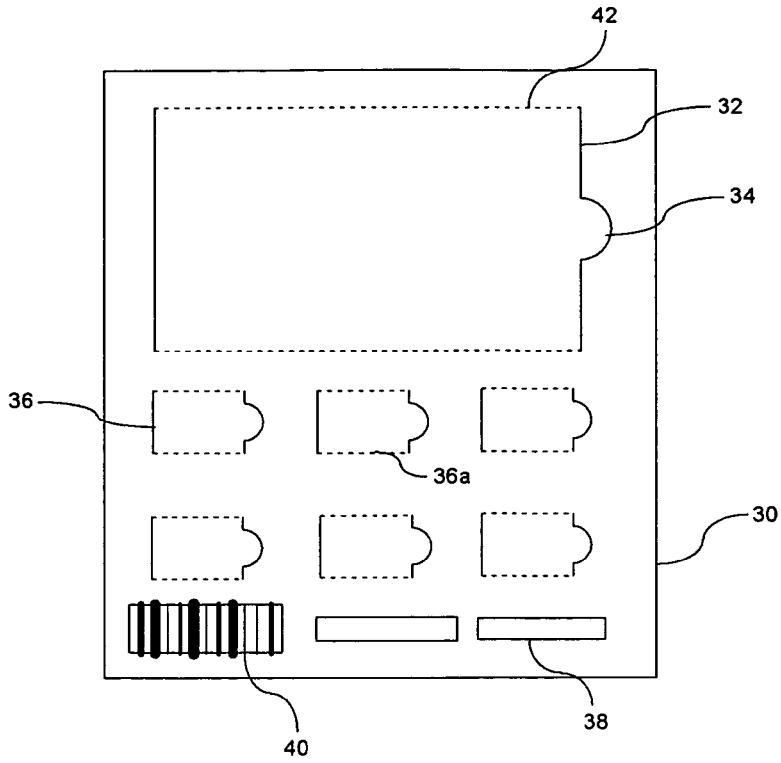
FIG. 2 is a diagrammatic representation of a pull-tab skill poker game card.

Making reference now to FIG. 2, a pull-tab skill poker game 30 is shown. With the purpose of concealing the cards being played, perforated pull-tabs are used. A first pull-tab 32 is used to conceal the dealt cards that represent an individual hand. Each player station 22 receives a pull-tab card 30 and players at like station numbers (same tournament group) receive identical pull-tab cards 30. Upon commencement of the game, the players reveal the hand by gripping a small tab 34 at one end of the card 30 and pulling in the opposite direction, which separates the pull-tab 32 from the card 30 by breaking the perforated edges 42 during the tearing motion. It may be appreciated that the tabs can be removed in other ways and is not limited to the use of a perforated edge. Similarly, adhesive strips or non-perforated paper strips may also be used. In a similar manner, a plurality of smaller tabs 36 that conceal draw cards are revealed at the instruction of the dealer 24. In addition to concealing the cards used to play the skill game, the card 30 also contains information 38 either printed directly on or contained in a bar code 40 that may comprise a batch number, tournament group number, table number, player number, dealer number, round number and hand number for auditing purposes. The game cards 30 allow for gaming establishments to keep track of information based on an individual card 30, player or tournament group.

Figure 5:
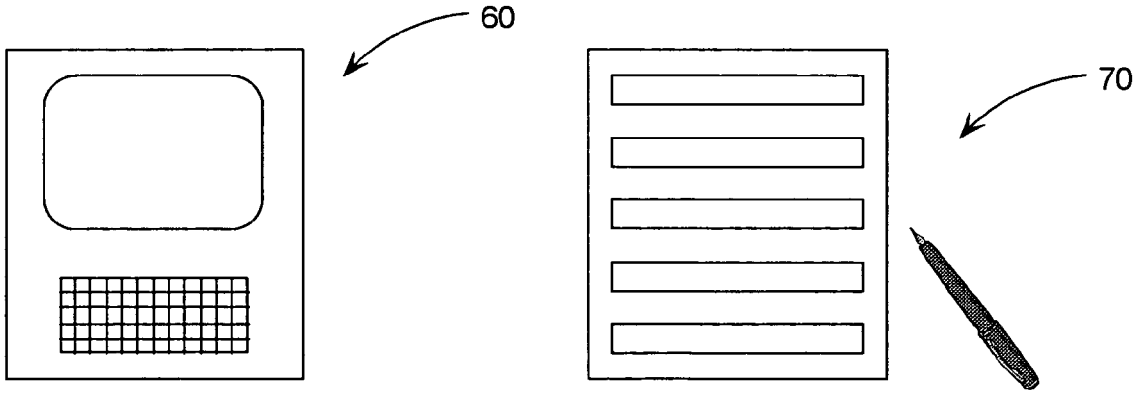
FIG. 5 is a diagrammatic representation of an electronic and manual entry system for gaming auditing.

The information contained on the card 38 is associated with an auditing system that is established at the time of manufacture. The information described above is retained along with the knowledge of the order of the cards dealt and played to incorporate auditing and security reviews into the tournaments. The dealer may be provided this information at the time of dealing or after the hands have been played for auditing purposes. The prior knowledge of the pre-ordered sets of cards allows gaming establishments to know which player at a tournament table 18 should win, thereby giving them an indication of whether any cheating or dealer and player collusion is taking place. In addition, making reference to FIG. 5, a bet tracking sheet 70 may be used in conjunction with the auditing system described above to track player actions and to calculate cash flows for each table 18. A player would be required to fill in information pertaining the hand being played as the hands are played to be submitted at the end of the tournament.

Figure 3:
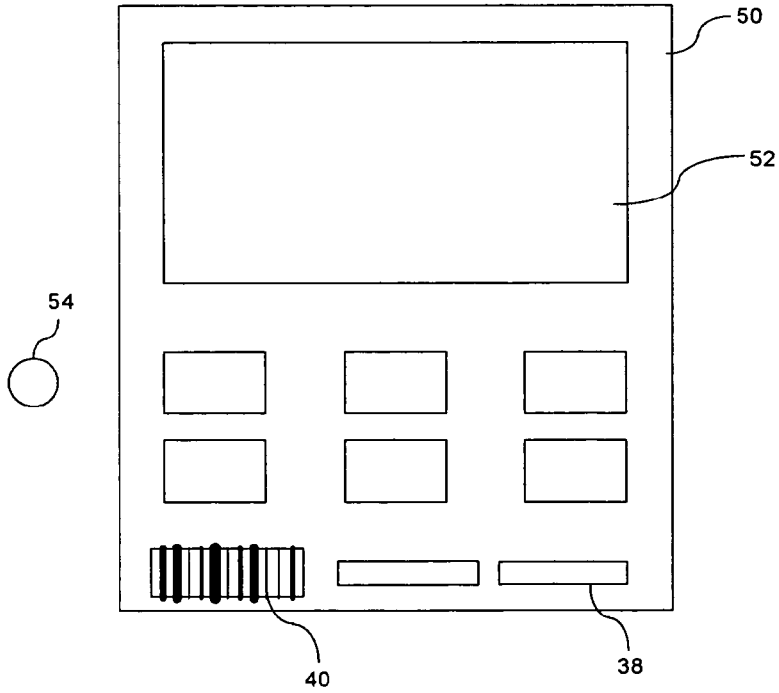
FIG. 3 is a diagrammatic representation of a scratch skill poker game card.

With reference now made to FIG. 3, a scratch skill game card 50 is shown. Similar to the above mentioned pull-tab skill game card 30, the scratch game card 50 conceals dealt and drawn cards. In this case, the cards are concealed using a material 52 that is removed by a coarse edge of a separate object such as by way of, for example a coin 54. This type of material is well known in its use for concealing information such as prizes or game pieces. In addition, similar to the pull-tab game card 30, the scratch game card 50 contains pertinent information 38, for use by the gaming establishment 16.

A typical skill card tournament using pull-tab cards 30 begins with the pre-packaging of hands 28 that are distributed 20 in a delivery by means of a truck to the physical locations 16 where players gather to play. In this case, location #1 16 is illustrated in which there are three tables 18. The tournament organization is such that each dealer 24 at each table 18 distributes an identical collection of hands 28. Each collection of hands 28 contains one hand for each of the eight tournament groups represented at that table. The hands are distributed such that each of the three players in tournament group location #1 (seated at different tables) receives an identical hand, each player in tournament group location #2 receives an identical hand and so forth. Therefore a dealer 24 simply opens one package 28 for each round dealt in a tournament. A set of these packages 26 will be distributed to each tournament table 18 such that there are a sufficient number of rounds to last the desired length of a tournament. With this structure, identical hands can not only be played by a tournament group in a single location but can also be played by tournament groups in a system of physical locations 10 as shown in FIG. 1. It may be appreciated that the number of tables and similarly the number of tournament groups is not limited to 3 and 8 respectively but may be of any size at the discretion of the gaming establishment. In addition, each table operates in a similar fashion and therefore the operations for only one table will be discussed in detail.

Figure 6:
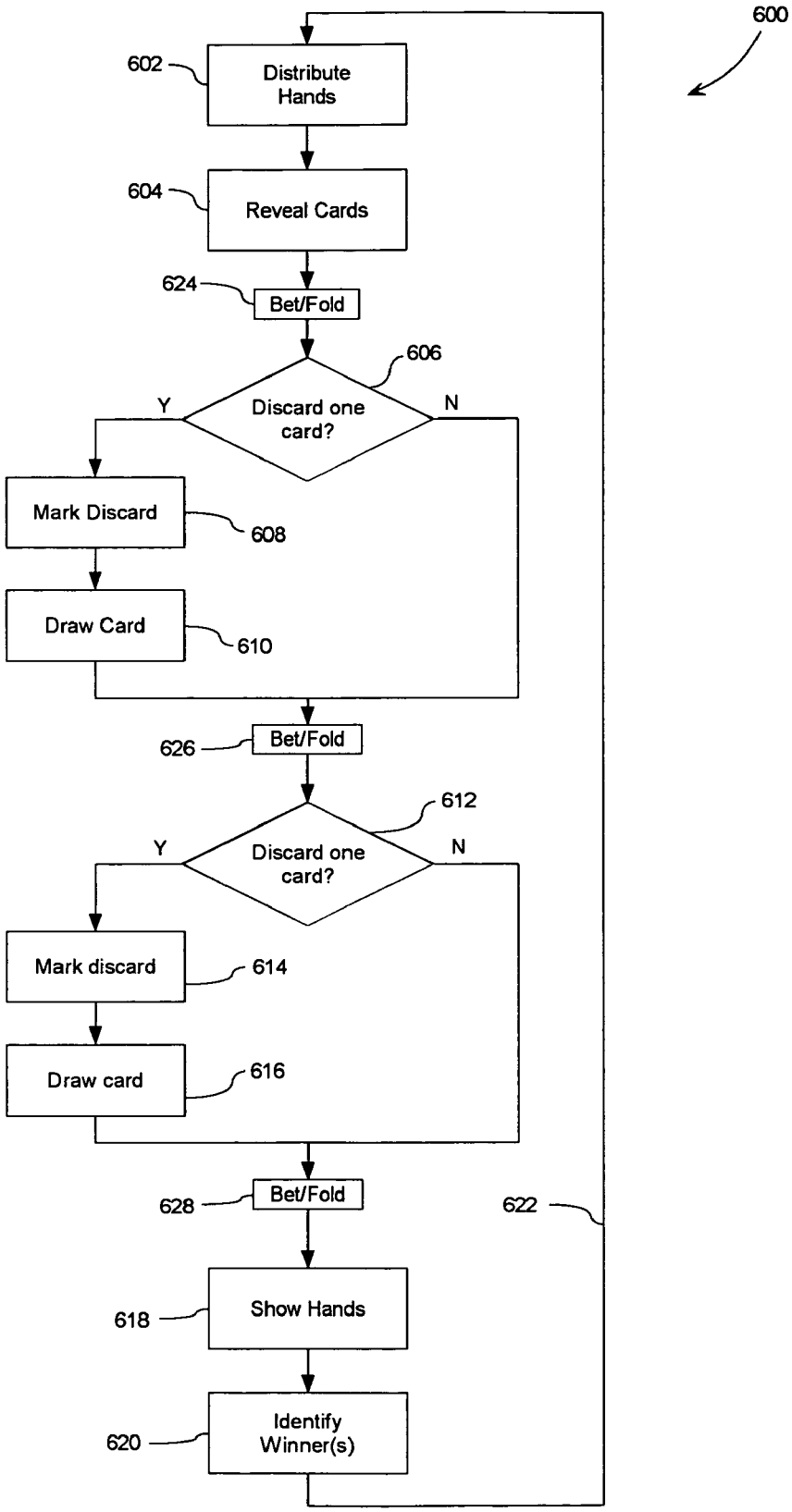
FIG. 6 is a functional block diagram of a two draw skill poker game.

For each round, a pre-packaged set of hands 28 is opened and distributed by the dealer 24 to the player's stations 22 at his or her table 18. A typical skill poker game with two draws of one card each draw 600 is shown in FIG. 6. The hands 30, 50 are distributed 602 to the players 22 and at this point the dealer 24 instructs the players 22 to reveal their hands to themselves 604. This is accomplished by pulling a pull-tab 32 or scratching the appropriate surface 52 as described above. Appropriate bets can be made at this point 624 by the individual players, or the player may fold their hand, and if a card is to be discarded 606 it is identified after betting is done. This can be accomplished by marking the card 30,50 or by using a push-through perforation if available 608. The dealer 24 then instructs players who will draw to make their first draw 610 by removing the first draw card pull-tab 36. At this point each player has drawn the same card to be played 604 as players in their corresponding tournament group, but draw different cards than those played by other players 22 at the same table 18. It is now up to the skill of the player whether playing the card 604 has helped their chances in comparison to the success of their tournament group competitors playing at other tables 18. At this point, betting or folding will take place again 626 based on the success of the first draw 610.

The second draw works in a similar fashion. The players decide whether to discard one card 612. This card is marked 614 similar to the first round. The second draw 616 is done by pulling the second draw card pull-tab 36*a*. At this point, the hands are final and this concludes a two round draw of a single card game of skill poker. The players make their final bets or decide to fold their hand 628 then reveal their final hands 618 to the dealer 24 and the winner or winners are identified 620. The success of each player is recorded to allow comparison to the other players in their tournament group. This cycle repeats 622 for each hand played in the tournament.

Figure 7:
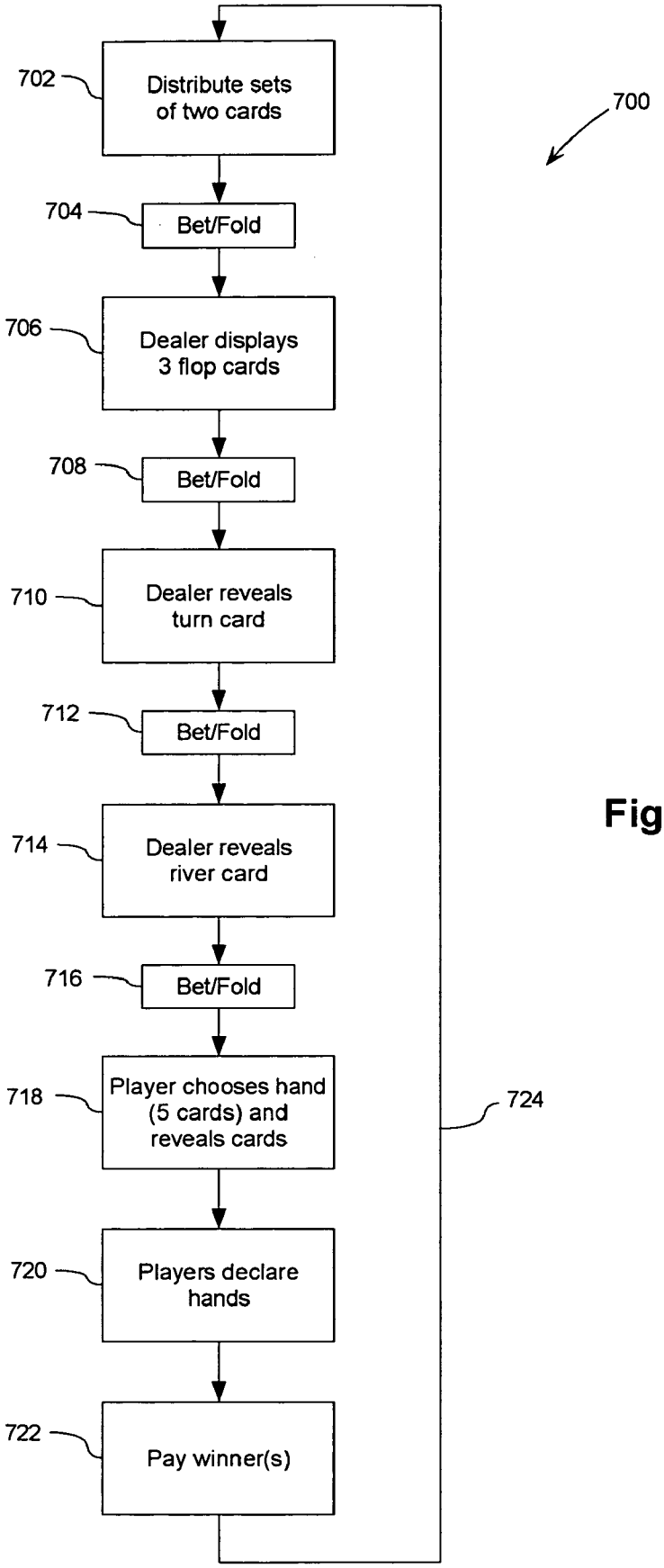
FIG. 7 is a functional block diagram of a Texas Holdem skill poker game.

Another example of the present invention will now be given describing a skill game of Texas Holdem to further illustrate the method herein. This example is shown in FIG. 7 which is a flow diagram of a typical game of skill Texas Holdem 700.

The game 700 begins with the dealer distributing pre-packaged hands 702 that include 2 cards each and may be in any form described above. As in the two draw skill poker game described in FIG. 6, players of the same tournament group are seated at the same seat number at each table and it is understood that the structure of the tournament is as described above. A round of betting occurs at this point 704 or the players may fold. The dealer has a pre-packaged set that in this case includes three flop cards which every player will use to complete a first hand of 5 cards. The dealer also has two single card draws named a turn card and a river card. This set of five cards is together in a pre-ordered set for the dealer to open once the player cards are dealt. The dealer displays the 3 flop cards 706 and another round of betting or folding occurs 708 based on the complete hand of five cards which includes the individual player's cards as well as the 3 flop cards that each player includes. The dealer then reveals the turn card 710, and based on the turn card, another round of betting or folding occurs 712. The players bet based on the best possible hand that can be made using 5 of the 6 cards revealed for play at this point.

The dealer now reveals the river card 714 which is similar to a second draw in regular poker. Based on the addition of the river card to the cards revealed for play, another round of betting or folding occurs 716. At this point the players bet based on choosing a hand of 5 cards from the 7 available cards. The players are then instructed to choose their final hand of 5 cards. These cards are revealed 718 and the players subsequently declare these hands to the dealer 720. The dealer 24 then pays the winner or winners 722 and the next hand begins 724.

It is appreciated that the example of the present invention in regard to Texas Holdem is implemented using the same tournament structure as the example involving a two draw poker game and the example is given only to illustrate the use of skill games in a different context. It is also appreciated that for both skill game examples, conventional rules of poker not discussed are used such as the hierarchy of hands in determining a winner and the ability to fold a hand instead of betting at any time during the game. It is recognized that variations to the rules may be made in accordance with local customs while still using the pre-ordered packages of hands 14.

Similarly, using the above described physical tournament environment, it may be desirable to pre-package hands 28 using individual cards that are used in conventional gaming. This would include a package 28 distributed to each player that contains a hand of individual, traditional playing cards 28 instead of a hand concealed on a pull-tab 30, scratch card 50. This embodiment is desirable when a traditional game atmosphere is wanted. This requires dealt hands and draw cards to be packaged much like sports trading cards wherein multiple individual cards are packaged together. Similarly, rip-open envelopes may be used, the envelope being opened by removing a perforated edge which unfolds the envelope to reveal concealed cards. It will be recognized that various forms of pre-packaging may be used and is not limited to the methods described herein.

In further embodiments of the present invention it is understood that skill games other than that of poker can be implemented according to the pre-ordered, pre-packaged distribution 10 described herein. Card games such as bridge or black jack, or board games using dice such as Monopoly or backgammon can be implemented. Similar to concealing playing cards, dice rolls and subsequent player moves can be pre-organized in a similar manner as described for poker such as using pull-labs to conceal the dice rolls. In this fashion, players in similar tournament groups are compared as to how they fared against their opponents when given the same dice rolls. Timed games such as bingo, skill trivia games or symbol matching games which require players to respond in the shortest amount of time can also be implemented with the system described.

It will be understood that in the above embodiments, the order of the cards is known to the distribution source 12. While this information must be maintained in confidence during the game, it can be used after a game by security staff to audit the game. This information could be provided using, for example, a control sheet provided to security after completion of the game. Security staff can verify that the order of the cards that were dealt is the same as the pre-ordering established at the distribution source 12 and that similar results were obtained at each of the tournament tables 18.

It is understood that in addition to the physical system described in reference to FIG. 1 and more particularly to the tournament table configuration as seen in FIG. 4 the skill games can be electronically controlled using a closed network within one tournament location 16 or can be linked in parallel with the distribution network 10 described with reference to FIG. 1. The distribution of skill games electronically is known and the physical implementation described herein can be implemented electronically with electronic display terminals 60, giving reference to FIG. 5, at each player location 22. Electronic implementation allows the distribution of tournament locations 10 to be broadened and also increases the number of hands that can be distributed in a given time.

Figure 8:
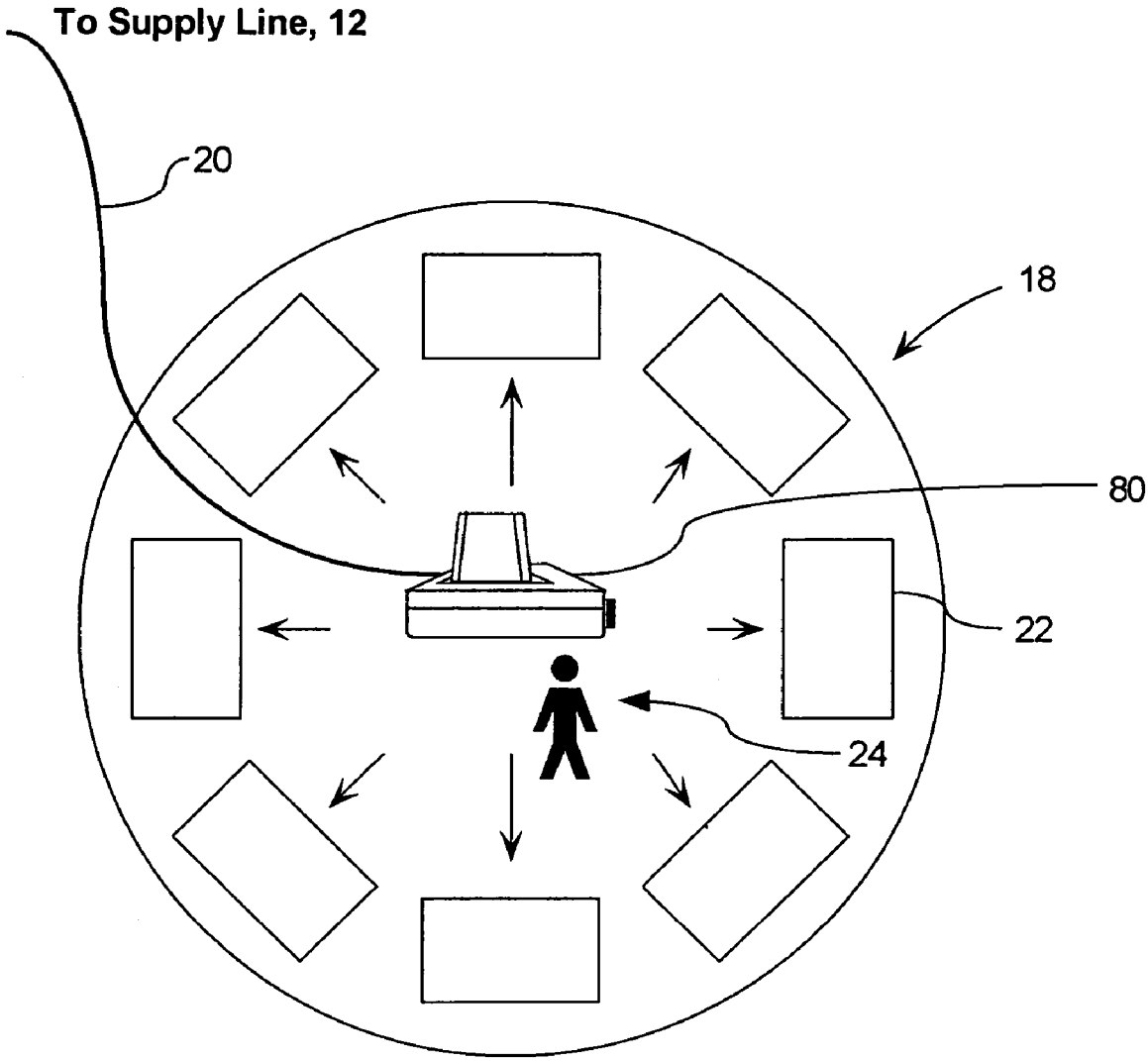
FIG. 8 is a schematic of a single tournament table utilizing a printing terminal.

An electronic implementation can also include the electronic control of auditing information, by inputting information into the aforementioned electronic display terminal 60. In addition, reference is now made to FIG. 8 in which a table 18 is equipped with a printing terminal 80. In place of using the pull-tab 30 or scratch game 50 cards shown in FIGS. 2 and 3 or the electronic display terminals 60 it is understood that by using a printing terminal 80, individual hands 28 and draw cards can be printed at each table 18 for each hand the dealer 24 distributes. The use of a printing terminal 80 may be used internally within an electronic network and may act as a suitable distribution path 20 for distributing pre-ordered hands to be played in a tournament setting.

It is understood the above described embodiments of the present invention describe suitable methods for implementing a game of skill in a physical environment and it may be appreciated that various modifications and alterations may be made by someone skilled in the art without escaping from the scope of the present invention. Although the above description describes a system for implementing a game of skill in a physical environment, it may also be appreciated that the system described herein and its many features such as the means for auditing, may be implemented in other applications such as in traditional games of chance.

What is claimed is:

1. A gaming system comprising: a plurality of tournament tables in at least one physical location, each of said tables having a plurality of stations to permit players to play a game against each other; a plurality of tournament groups, each tournament group comprising one of said stations from each of said tables; a set of identical hands for each tournament group; and a game package for each table, each said game package containing one hand chosen from each of said set of identical hands and being distributed to respective tournament tables; wherein each player in each group plays an identical hand at their respective table against players from the others of said groups, such that players at the same table play different hands, and each said game package wherein players are evaluated against others in the same group thereby playing a game of skill.

2. A system according to claim 1 wherein each tournament table has a plurality of sets of pre packaged hands sufficient in number to satisfy the length of the tournament.

3. A system according to claim 1 wherein each player participating in a tournament is assigned a player number that identifies a player in recording the number of hands played, bets made, a table number, a tournament location and other auditing information desired by the particular gaming institution.

4. A system according to claim 1 including a timer to limit play at each table.

5. A system according to claim 1 wherein each of said prepackaged hands include a covering to conceal the playing cards until they are to be played.

6. A system according to claim 5 wherein the initial hand of cards is concealed using a single covering and at the appropriate time, the players are instructed to reveal the hand to themselves.

7. A system according to claim 5 wherein said covering comprises one of a pull tab and a scratch surface.

8. A system according to claim 1 further comprising an electronic network for distributing said game packages, and a display for each player at each table for displaying said hands.

9. A system according to claim 1 further comprising an identifier on each of said hands containing information for auditing purposes.

10. A system according to claim 9 wherein said information is provided by a bar code, said bar code used to provide any one or more of a batch number, a tournament group number, a table number, a player number, a dealer number, a round number and a hand number.

11. A method of organising a gaming tournament having a plurality of tournament tables in at least one physical location, each of said tables having a plurality of station to permit players to play a game against each other, said method including the steps of arranging a plurality of tournament groups, each group comprising one of said stations from each of said tables; preparing a set of identical hands for each tournament group; preparing a game package for each table, each said game package containing one hand from each of said set of identical hands such that players at the same table play different hands; and distributing each said game package to respective tournament tables; wherein each player in each group plays an identical hand at their respective table against players from the others of said groups, and wherein players are evaluated against others in the same group thereby playing a game of skill.

12. A method according to claim 11 wherein multiple tournament tables are arranged in multiple physical locations and pre-packaged sets of hands are distributed to each location.

13. A method according to claim 11 wherein said game is implemented with electronic equipment at each player location so as to play in a physical location under a closed network.

14. A method according to claim 11 wherein each of said prepackaged hands include a covering to conceal the playing cards until they are to be played, said covering comprising one of a pull tab and a scratch surface.

15. A method according to claim 11 further comprising the steps of establishing an electronic network for distributing said game packages, and providing a display for each player for displaying said hands.

16. A method according to claim 11 further comprising gathering information for auditing purposes, said information being included in an identifier on each of said hands.

17. A method according to claim 16 wherein said information is provided by a bar code, said bar code used to provide any one or more of a batch number, a tournament group number, a table number, a player number, a dealer number, a round number and a hand number.

* * * * *